US005127369A

United States Patent [19]

Goldshtik

[11] Patent Number: 5,127,369

[45] Date of Patent: Jul. 7, 1992

[54] ENGINE EMPLOYING ROTATING LIQUID AS A PISTON

[76] Inventor: Mikhail A. Goldshtik, 8951 Braesmont, #231, Houston, Tex. 77096

[21] Appl. No.: 703,628

[22] Filed: May 21, 1991

[51] Int. Cl.[5] ..... F02B 75/00

[52] U.S. Cl. ..... 123/19; 60/516

[58] Field of Search ..... 123/19, 65 R, 311; 60/516, 721, 517; 91/4 R

[56] References Cited

U.S. PATENT DOCUMENTS

| | | | |
|---|---|---|---|
| 781,923 | 2/1905 | Vogt | 123/19 |
| 2,658,486 | 11/1953 | Waide | 123/19 |
| 3,135,094 | 6/1964 | Kress | 123/19 |
| 3,608,311 | 4/1970 | Roesel | 60/516 |
| 3,803,847 | 4/1974 | McAlister | 60/721 |
| 3,815,555 | 6/1974 | Tubeuf | 123/19 |
| 3,890,784 | 6/1975 | Tubeue | 60/516 |
| 3,901,033 | 8/1975 | McAlister | 60/516 |
| 3,998,049 | 12/1976 | McKinley et al. | 123/19 |
| 4,085,710 | 4/1978 | Savarimuthu | 123/19 |
| 4,195,481 | 4/1980 | Gregory | 60/516 |

OTHER PUBLICATIONS

*Swirl Flows*, by A. K. Gupta, D. G. Lilley and N. Syred, Abacus Press (Jan. 1984) pp. 1-69 and 295-375.

*Fluid Power Design Handbook*, by Frank Yeaple, Marcel Dekker, Inc.(Jan. 1984), pp. 103-132.

*The Technology of Fluid Power*, by William W. Reeves, Prentice Hall, Inc. (Jan. 1987), pp. 172-179.

*Primary Examiner*—David A. Okonsky

[57] ABSTRACT

A rotating-liquid piston engine having two or more cylinders that are partially filled with a fixed volume of liquid and are interconnected by two tangentially-connected, unidirectional flow tubes or pipes containing hydromotors. For an internal combustion engine, each of these cylinders has a top and bottom cover and a system for intake of fuel and air and an associated exhaust system. Each cylinder may have either an electric spark plug or work in a diesel mode (via an injector). The liquid in each cylinder is caused to rotate in a circle around the cylinder wall at high speed and create a vortical liquid body with a cylindrical cavity in the middle of the liquid. Rotation is used to totally stabilize the working surface of the cylindrical cavity whose surface is the "top" of the rotating-liquid piston. This cavity is the combustion chamber into which the mixture of fuel and air is injected. When the fuel mixture is burned, pressure in the cavity inside the rotating-liquid causes some of the liquid to be pushed out through a tangential outlet tube, through a hydromotor into the inlet of the second cylinder (where this cycle is repeated) and liquid flows back into the first cylinder again. In this manner, fluid is transferred back and forth between the two cylinders at some variable frequency, as a result of the pressure from combustion.

13 Claims, 4 Drawing Sheets

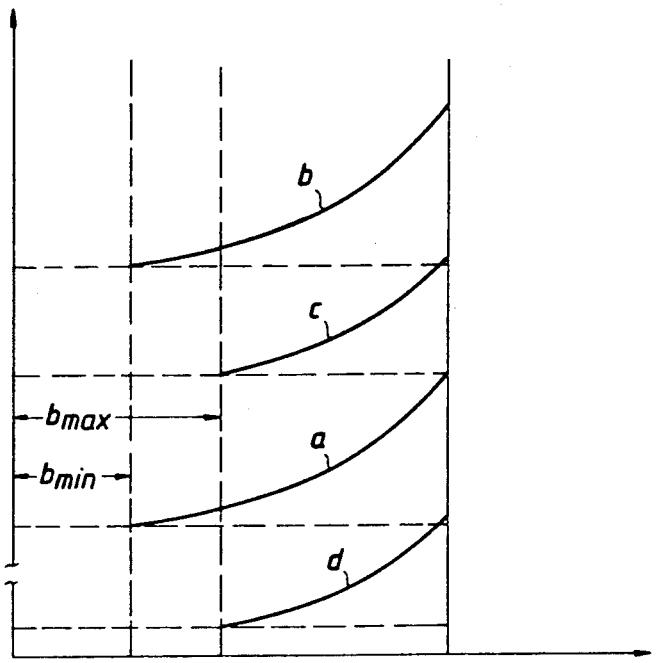
FIG.7
FIG.5
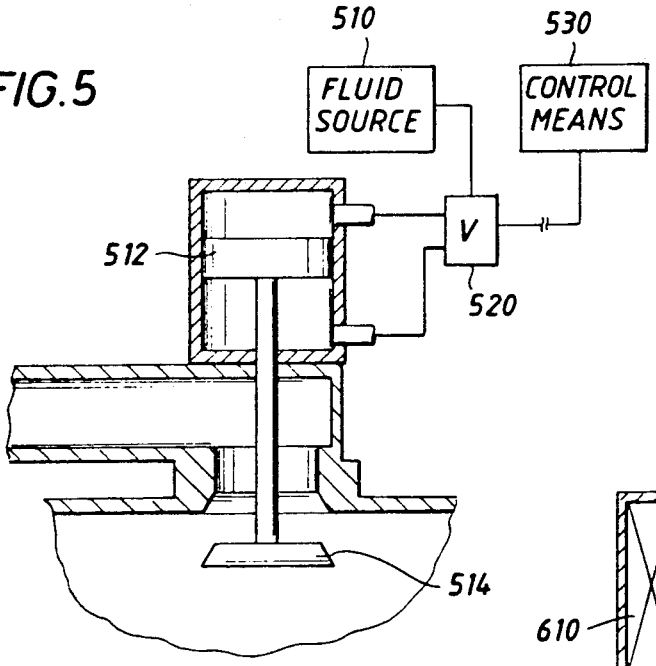
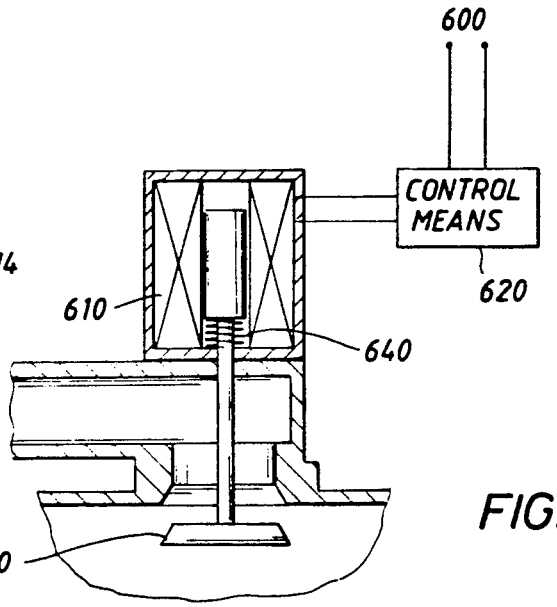
FIG.6

ENGINE EMPLOYING ROTATING LIQUID AS A PISTON

BACKGROUND OF THE INVENTION

This invention relates to engines that employ pistons, and more particularly, relates to engines employing rotating liquid as a piston.

Engines employing pistons are well known in the prior art. In general, these prior art engines employ a piston which moves up and down inside a cylinder with the piston connected to a crankshaft via a connecting rod and the crankshaft then translates the linear up and down motion into rotational motion. This rotational motion is then used, via a gear box or other transmission mechanisms, to cause rotation of a drive mechanism to thereby impart motion to a movable vehicle. For example, the rotational motion from the crankshaft may be used to drive an electric generator, wheels, a propeller on an airplane, or a propeller for a boat. In general, such piston engines are used to transform the thermal energy from the combustion of a hydrocarbon fuel into kinetic energy associated with work, such as the movement of a vehicle.

However, conventional piston engines have relatively complicated designs and have large energy losses associated with the conversion of the energy from the combustion of the fuel into the kinetic energy associated with work or movement. In addition, these engines require complicated cooling systems to remove the heat of combustion (for internal combustion engines), and lubricating devices to provide a continuous flow of lubricating fluids to metallic parts that are rotationally or slidingly contacting each other. Further, these engines are generally very heavy because of all the associated auxiliary equipment necessary to support the engine and to convert the rotational energy into an appropriate and different form of easily useable energy. Such engines employing pistons may be internal combustion engines (otto and/or diesel cycles) or external combustion engines (such as a steam engine).

A flat, liquid piston external combustion engine is known in the prior art (*Liquid Piston Stirling Engines*, by C. D. West, Van Nostarand Reinhold Company, 1983, p. 5, FIG. 1.5) and is depicted in FIG. 1. This liquid piston engine is very simple in its design and does not employ complicated mechanical parts (such as pistons, connecting rods, and crankshafts) or any other type of transmission element. The engine basically consists of two cylindrical vessels that are partially filled with liquid and are interconnected by two parallel conduits or pipes, with the conduits or pipes having appropriate valves where the conduit or pipe connects with the cylindrical vessel. The valves ensure that flow through a conduit or pipe is only in one direction. When the air above the fluid in one of the cylinders is heated, via heat from an external combustion source, the pressure of the air expansion (from heat) forces the liquid to move from the "heated" first cylinder into the "cool" second cylinder through one of the one-way pipes interconnecting the two chambers. As the liquid flows from one cylinder to the other cylinder, it may then be used to rotate a hydromotor and the hydromotor may then perform useful work. This may continue until the expansion has reached some maximum amount, then the air in the first cylinder is "cooled" and the air in the second chamber is heated to drive the liquid in the opposite direction through the second one-way interconnecting pipe, and again via the hydromotor extract some work from the fluid flow.

The main drawback of an engine having a flat liquid piston is the poor stability of its top surface, because this surface is liquid. More particularly, when the "piston" is near its top dead center, its speed becomes zero but the acceleration normal to the top surface is maximum, and if this acceleration exceeds the acceleration of the force of gravity then the flat liquid surface of the piston is destroyed by this acceleration. Under these conditions a stability criterion that is the ratio of gravity (g) divided by the acceleration (a) of the piston must be more than one so that no liquid will leave the surface of the flat liquid surface of the piston because of such acceleration inertia.

Such a flat liquid piston engine has only been run successfully under laboratory conditions. The power from one of these flat liquid piston machines is, at best, only several watts and their efficiency is not more than about one percent. Further, the frequency of this engine, i.e, the frequency of the shifting of the fluid back and forth between the two cylinders, is only a fraction of a Hz in order to avoid the instability of the top surface of the liquid piston. Additionally, this engine is very sensitive to orientation, vibrations and inertial overloading; any engine that is associated with movement of vehicles must be insensitive to these factors.

These and other limitations and disadvantages of the prior art are overcome by the present invention, however, and improved methods and apparatus are provided for an engine employing rotating liquid as a piston.

SUMMARY OF THE INVENTION

In its broadest aspect, the present invention provides an engine employing rotating liquid as a piston. In a preferred embodiment of the present invention, this engine is an internal combustion engine and has two cylinders (cylindrical vessels) that are partially filled with a fixed volume of liquid and are interconnected by two tangentially-connected, unidirectional flow tubes or pipes (that carry liquid in opposite directions) containing hydromotors. Each of these two cylinders has a top and bottom cover and a system and inlet valve for intake of fuel and air, as well as an associated exhaust valve and exhaust system. The system for providing fuel and air may include fuel injectors. The cylinders can either have an electric spark plug with an associated ignition system, or work in a diesel mode and employ injectors. Because of the tangential inlets, the liquid in each cylinder is caused to rotate in a circle around the cylinder wall at high speed and create a vortical liquid body with a mostly cylindrical cavity in the middle of the liquid. Rotation is used to totally stabilize the cylindrical, mostly vertical working surface of the cavity whose surface is the "top" of the liquid piston; this cavity serves as the combustion chamber into which the mixture of fuel and air is injected, via an appropriate valve. When the fuel mixture is burned, pressure in the cavity inside the liquid causes some of the liquid to be pushed out through a tangential outlet tube and through a hydromotor (to extract useful work) into the tangential inlet of the second cylinder. The combustion products in the cavity are exhausted, via an appropriate valve, and a new charge fuel and air injected into the cavity. This cycle is repeated in the second cylinder, and liquid is forced back into the first cylinder. In this manner, fluid is transferred back and forth between the two cylinders at some variable frequency, as a result of the pressure from combustion. A control means controls the operation and timing of the various components of the engine of the present invention.

Alternatively, a single cylinder embodiment of the present invention having such a rotating-liquid piston, may be employed with a pressure reservoir to accomplish suitable work. In addition, such a single piston configuration may be used in certain applications to pump the same fluid that is being used as the fluid to generate the rotating cylindrical piston.

It is an object of the present invention to provide a rotating-liquid piston engine that is small and light and can generate large amounts of power.

It is an object of the present invention to provide a rotating-liquid piston engine that is simple to service and repair.

It is an object of the present invention to provide a rotating-liquid piston, internal combustion engine that does not require cooling systems or lubrication of any of its power-generating parts.

It is an object of the present invention to provide a rotating-liquid piston engine that has reduced quantities of environmentally-damaging emissions.

It is an object of the present invention to provide a rotating-liquid piston, internal combustion engine that has reduced sensitivity to detonation, has a high compression ratio and has a high thermal efficiency.

It is an object of the present invention to provide a rotating-liquid piston engine that may employ any kind of combustible hydrocarbon gas or liquid as a fuel.

It is an object of the present invention to provide a rotating-liquid piston, internal combustion engine that has improved fuel efficiency.

Accordingly, these and other objects and advantages of the present invention will become apparent from the following detailed description, wherein reference is made to the Figures in the accompanying drawings.

IN THE DRAWINGS

FIG. 5 is a simplified schematic diagram of the operation of an inlet and/or outlet valve of the embodiment depicted in FIG. 2.

FIG. 6 is a simplified schematic diagram of an alternate operation of an inlet and/or outlet valve of the embodiment depicted in FIG. 2.

FIG. 7 is a simplified functional diagram representing pressure curves and cavity radii associated with a rotating-liquid piston in an internal combustion engine of the present invention.

DETAILED DESCRIPTION OF THE INVENTION

Figure 1:
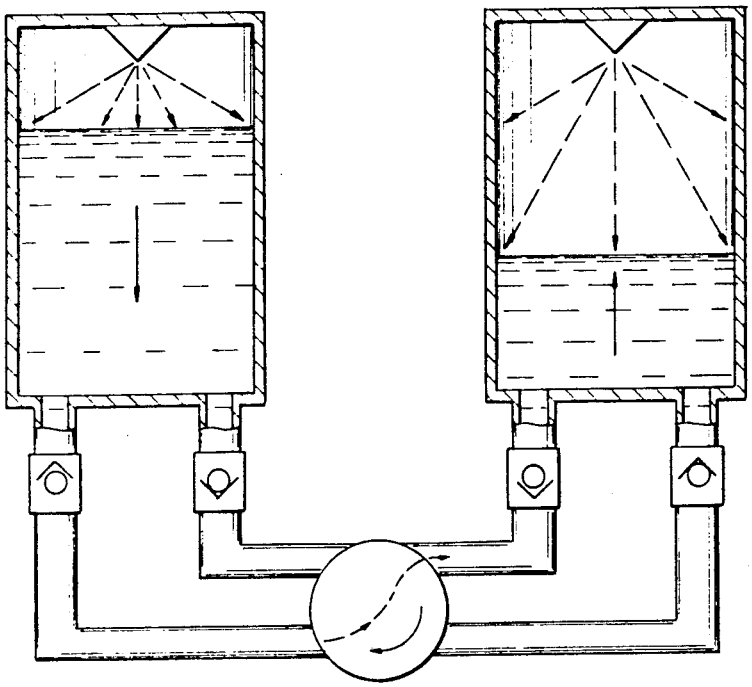
FIG. 1 (PRIOR ART)
FIG. 1 is a simplified vertical view, partially in cross-section, of a prior art Stirling, two-cylinder, flat, liquid piston engine.
Figure 2:
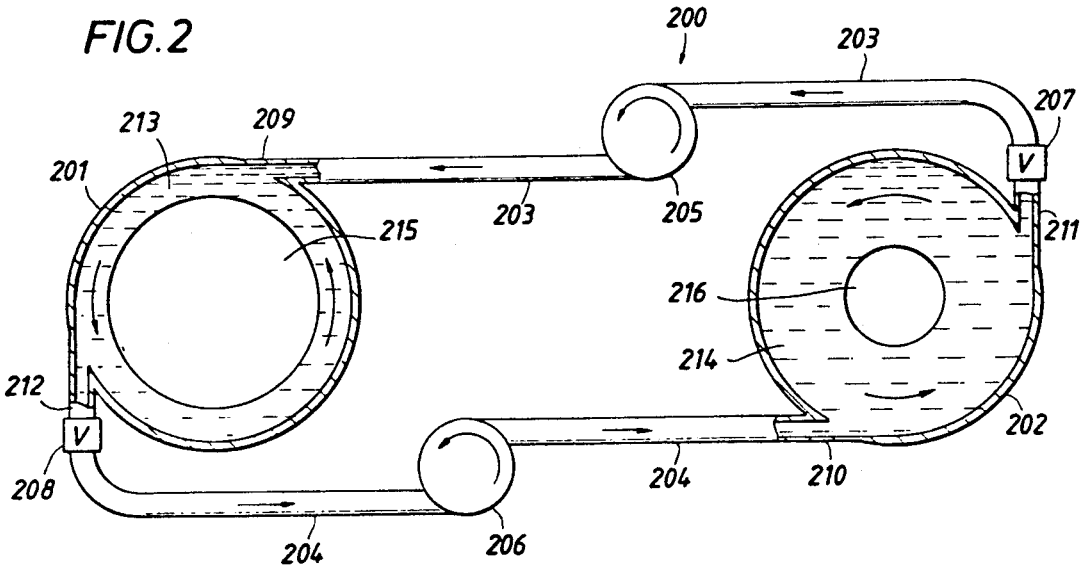
FIG. 2 is a simplified horizontal view, partially in cross-section, of the preferred two cylinder embodiment of the rotating-liquid piston, internal combustion engine of the present invention.

Referring now to FIG. 2, there may be seen a simplified horizontal view, partially in cross-section, of a preferred internal combustion engine 200 embodiment of the present invention employing two cylinders 201, 202 connected by two tangentially-connected, unidirectional flow tubings 203, 204 with a hydromotor 205, 206 located in each one of these tubings. Alternatively, one hydromotor (not shown) may be employed and interconnected with the flow tubings 203, 204 in the manner depicted in FIG. 1. Each tubing 203, 204 has one (or more) valve(s) 207, 208 to control the direction of fluid flow in it. Preferably, these tubings 203, 204 are as short as possible. These flow control valves 207, 208 may be controlled in accordance with the compression and work phases of the respective cylinders of the engine. The control of these valves 207, 208 may be electrical, mechanical, pneumatic, or hydraulic. For example, each flow control valve 207, 208 may be operated by a sensor which is located upstream of the valve in the tubing; the sensor will then open the valve 207, 208 as soon as there is a preselected pressure differential or pressure in the tubing. Alternatively, the flow control valves 207, 208 may be spring-loaded check valves that require a preselected pressure to open. As noted later herein, this pressure differential may be caused by expansion of a cavity from combustion, from rotational inertia, or from a pressure receiver.

As may be seen from FIG. 2, the inlet 209, 210 and outlet 212, 211 of fluids into each cylinder 201, 202 is achieved via a single tangential inlet and single tangential outlet connection. Tangential is used in its usual meaning as an inlet or outlet contacting the cylinder at a point to provide flow parallel to the curved cylinder wall at the point of injection or removal. Although the inlet 209, 210 and outlet 212, 211 ports are depicted, in FIG. 2, at the same level, they may be at the same or different levels. Similarly, although only one inlet 209, 210 and outlet 212, 211 port is depicted in FIG. 2, more than one such port may be employed for the inlet and/or outlet. For example, four such ports spaced 90° apart around the cylinder may be used as an inlet and/or outlet connection; similarly two such ports spaced 180° apart may also be so employed. In this manner the injected fluids form a rotating vortex 213, 214 within the cylinder 201, 202 against the cylinder wall and this rotating vortex 213, 214 of liquid has a basically cylindrical cavity 215, 216 in its middle as illustrated in both cylinders 201, 202 in FIG. 2. This cavity 215, 216 is the combustion chamber into which a mixture of fuel and air may be injected; the walls of this cavity 215, 216 form the "top" of a piston.

When the fuel is burned in this cavity 216 (for an internal combustion engine), the pressure resulting from the combustion of the fuel (inside the cavity) causes the radius of the cavity 216 to expand, i.e., the "thickness" or amount of the fluid associated with the rotating fluid piston in one cylinder 202 decreases. For an external combustion embodiment of this engine, a high pressure or high energy fluid may be supplied to the cavity 216 to cause this expansion. For example, such an external combustion cycle might burn fuel to convert water to high pressure or high energy steam and then employ the steam as the expansion force. This pressure causes a portion of the liquid to flow out through the appropriate outlet port 211 or ports, through a hydromotor 205 (via appropriate tubing 203) into the inlet 209 of the other cylinder 201 until a preselected maximum amount of expansion of the cavity has taken place. At this point, the pressure in the cavity 215 of the other cylinder 201 would be increased, either by ignition of its fuel mixture or entry of a high pressure fluid which would accordingly cause its rotating-liquid piston to have an expanding internal cavity 215 resulting in the flow of fluid through its discharge one-way flow conduit 204 and associated hydromotor 206, back into the other cylinder 202. In this manner, fluid is transferred back and forth between the two cylinders at some variable frequency, as a result of the pressure from combustion. For an internal combustion, two stroke power cycle, the power (combustion) "stroke" would alternate between the two cylinders. For an internal combustion embodiment of this engine, appropriate intake and exhaust valves will allow communication between the cavity and a fuel/air supply system and an exhaust system; similarly, for a "sparked" combustion an ignition system may be required.

For a four stroke power cycle, the increased rotational energy of the cylinder containing the smallest cavity is used in off-power "strokes" (expansion of a cavity) to provide the energy to move fluid from one cylinder (with a small cavity) to the other cylinder (with a large cavity). In addition, once the fluid motion has begun, it acquires its own "inertia" that tends to continue the fluid flow, even when the rotational energy of the fluids in the two cylinders is balanced or nearly balanced.

That is, the rotating liquid layer 213, 214 has a considerable amount of rotational kinetic energy that may be transformed into pressure during the operational cycle of the engine. The rotating liquid layer 213, 214 behaves partially as the flywheel of a conventional engine. This "liquid flywheel" allows the internal combustion engines of the present invention to operate in either a two-stroke or four-stroke cycle.

In general, the design parameters associated with an engine of the present invention are as follows. If the radius of the cavity 215, 216 inside a rotating-liquid piston is $b_{min}$ (where $b_{min}$ is the minimum cavity radius), then the expansion of the cavity 215, 216 results in a change of the radius to a radius of approximately $5b_{min}$, at the point where the expansion ceases from the expansion caused by combustion of the fuel or the injection of a high pressure or high energy medium into the cavity. The ratio of minimum radius to maximum radius is presently believed to be variable from about 1:2 to about 1:5. The cross-sectional area of a tangential inlet 209, 210 or outlet 212, 211 connection is preferably, approximately four percent of the area of the cylinder's wall; although this inlet or outlet area may vary from about one percent to about twenty percent of the area of the cylinder's wall. As noted before, more than one port may be employed for the inlet and/or outlet connection; the total area of such an inlet or outlet port is what may vary from about one to about twenty percent. The higher the area of an inlet or outlet, the lower the pressure drop and the higher the flow rate into or out of the cylinder.

The approximate volume of a cylinder may be determined from the desired power of the engine and the number of cylinders to be used. A mathematical model for a two cylinder engine is described later herein, and results in a formula for calculating power from many variables, some of which (radius and height) may be easily related to volume. A numeric example is also described later herein. The height and radius may be appropriately selected once the power (and accordingly cylinder volume) are known. Preferably, the ratio of radius to height is 1:1, but other ratios may be employed. For example (but not limited to) ratios of about 2:1 to about 1:5 may be employed. The ratio of the volume of gas to fluid in a cylinder may vary from about 0.1 to about 0.9; for an Otto cycle it is preferably about 0.8, as noted in the mathematical model described later herein. This ratio determines how much liquid is in a cylinder and depending upon the number of cylinders, flow tubes, hydromotors, etc. determines the "fixed" volume of the liquid to be employed in the engines of the present invention.

Figure 3A:
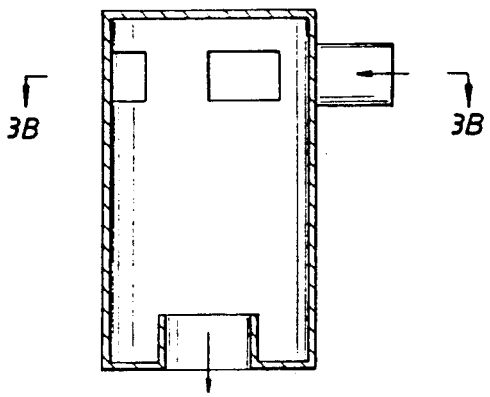
FIG. 3A (PRIOR ART)
FIGS. 3A and 3B depict a commercially available apparatus for establishing a rotating vortex of liquid.

The operating cylinders 201, 202 may employ any design that is capable of establishing a rotating vortex 213, 214 of liquid or gases; such designs may be based upon commercially available apparatus known to use swirling flows, for example, cyclone or vortex chambers. (See for example, *Swirl Flows*, by A. K. Gupta, D. G. Lilley and N. Syred, 1984, Abacus Press, pp. 295-376.) One such vortex chamber (from page 316 of this book) is depicted in FIGS. 3A and B.

Figure 3B:
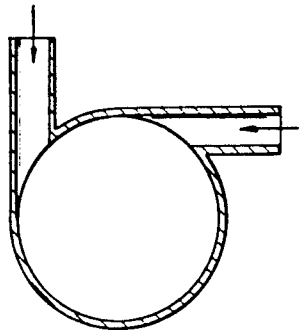
FIG. 3B (PRIOR ART)

FIGS. 3 A and B depict a vertical and horizontal section of a cyclone combustor, which is a combustion chamber for high calorie containing fuels that do not have serious slag and ash generation/removal problems. Cyclone combustors are typically used for the combustion and processing of materials that are considered hard to burn or process efficiently, such as vegetable refuse, high ash coals, anthracite, high sulfur coals, and certain mineral ores. In general, these known vortex or cyclone chambers employ a tangential inlet but also require a central outlet (rather than a tangential outlet) and are "open" systems where fluid flows into and through the chambers rather than using a fixed volume of fluid as does the preferred embodiment of the present invention. Additionally, these known devices do not employ a rotating liquid to create a central cavity for containing combustible gases and have that central cavity exposed to widely varying (and often high) pressures. Further, these known devices are "static" and do not have a periodic or oscillatory cavity size as does the present invention.

Hydromotors 205, 206 are also well known commercially available apparatus for converting fluid flow or fluid pressure into rotational motion. The term "hydromotor" is used herein to mean an apparatus or machine for converting fluid flow or fluid pressure into a rotational motion; for example, this conversion may be accomplished by a vaned shaft in a closed chamber with an appropriate inlet and outlet for a liquid to allow the liquid to rotate the vanes and thereby turn the shaft. Hydromotors are sometimes called hydrostatic motors and have a very high conversion efficiency (usually at least about 90%, some are as high as 99%). This rotational motion may then be used to drive appropriate drive mechanisms for a moveable vehicle, or otherwise provide useful work. Most such hydromotors are also reversible; that is, the hydromotor may also be employed as a hydropump to pump fluid if rotational energy is supplied rather than fluid flow or fluid pressure. Such hydromotors may be: an axial-piston, swash-plate hydromotor; a gerotor hydromotor; a ball- or cylindrically-opposed piston hydromotor; a vaned hydromotor; a meshed rotating gears hydromotor; or a cammed shaft or housing, radial, piston hydromotor. (See for example, *Fluid Power Design Handbook*, by Frank Yeaple, Marcel Dekker, Inc., 1984, pp. 104–133, or, *The Technology of Fluid Power*, by William W. Reeves, Prentice-Hall, Inc. 1987, pp. 172–179.)

Thus, known existing parts and pieces may be employed for the flow control valves, hydromotors and tubing, as well as for the carburetion, ignition and exhaust systems of the engine. However, all the pressure retaining components of an engine of the present invention need to be able to endure sufficiently high liquid pressures, for example, about fifty atmospheres.

Figure 4:
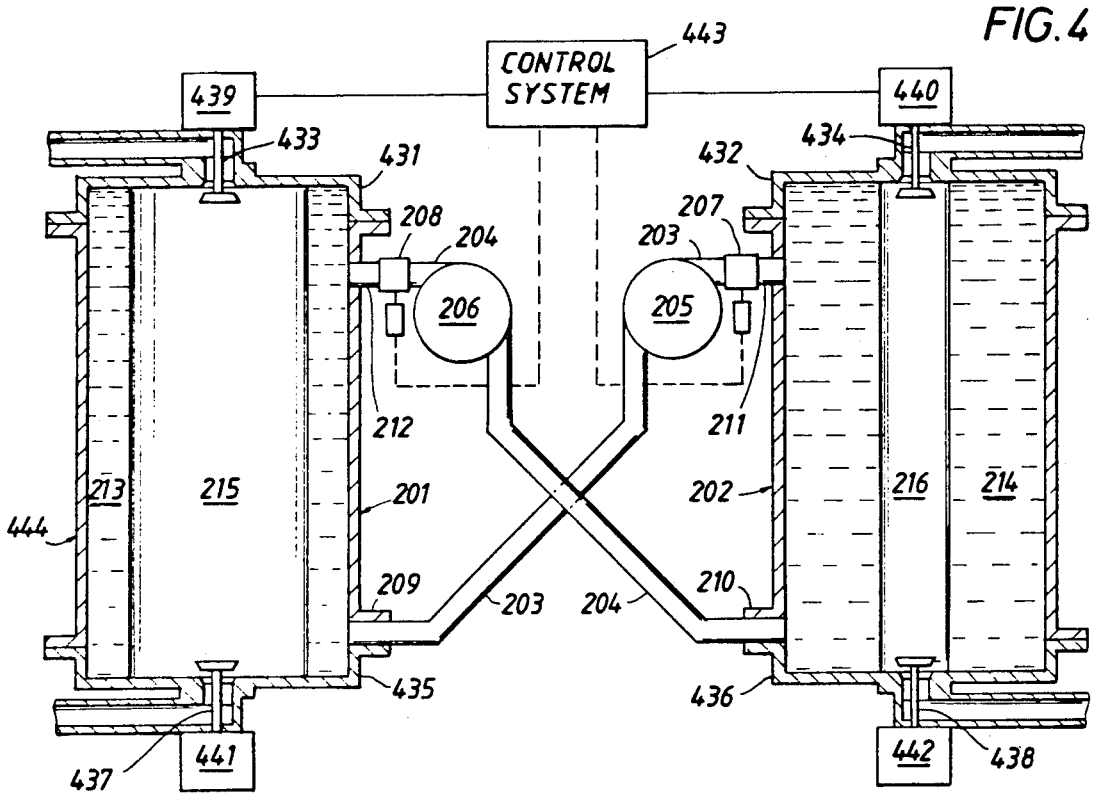
FIG. 4 is a simplified vertical view, partially in cross-section, of the preferred embodiment depicted in FIG. 2.

Referring now to FIG. 4, there may be seen a vertical view, partially in cross-section, of the embodiment depicted in FIG. 2. More particularly, it may be seen that there are upper covers 431, 432 that have intake valves 433, 434 (schematically depicted) associated with each of the cylinders 201, 202 and that there are lower covers 435, 436 which have exhaust valves 437, 438 (schematically depicted) therein. The tangential inlets 209, 210 and outlets 212, 211 for each cylinder 201, 202 may be situated at the same level or, as depicted in FIG. 4, they may be on different levels. Although depicted in FIG. 4 with the outlets 212, 211 at the top and the inlets 209, 210 at the bottom of a cylinder 201, 202 (for ease of depiction purposes), preferably, the outlet 212, 211 is at the bottom of the cylinder 201, 202 to allow for any residual pressure as a way to start the engine, as described later herein. For normal operation the cylinders 201, 202 should be partially filled with a liquid. Once the engine of the present invention is operating, the cylinders 201, 202 may be oriented at any angle, laid flat, or inverted.

Almost any non-compressible liquid may be employed in the engine of the present invention. For example, liquid fuel, water, or antifreeze may be employed as the liquid. If liquid fuel is employed, a fixed volume of this fuel may be used, or the fuel may be circulated through the engine to provide the fixed volume needed for the engine before combustion of the fuel. The "fixed" volume is the volume of liquid in the cylinders, flow tubes, hydromotors, valves, pressure receiver, etc. If necessary, this liquid may be "cleaned" to remove combustion products from the liquid to avoid contamination of the liquid or corrosion of the engine parts due to "chemicals" in the liquid. Particles in the fluid having a size of less than 20 microns do not present an erosion or corrosion problem and need not be removed as part of the "cleaning" process. A small amount of flow may be diverted from one (or both) outlet(s) to a filter/clean system to remove harmful combustion products and then back to the inlet; such a system may be as simple as an activated charcoal and/or wire mesh filter through which the fluid passes. However, the use of an external combustion cycle avoids any need to "clean" the liquid; such an external combustion cycle might be "burning" fuel to convert water to steam and then employing steam as the expansion force, i.e., a conventional steam engine employing the rotating-liquid piston of the present invention rather than a conventional reciprocating piston.

Again, the tangential inlet 209, 210 and outlet 212, 211 of fluids form a spinning vortex 213, 214 of liquid within the cylinder 201, 202, which is depicted in FIG. 4, and that liquid vortex 213, 214 contains a basically cylindrical cavity 215, 216 or combustion cavity 215, 216 at its center. Because of the same pressure within the cavity 215, 216, the surface of the cavity 215, 216 will be cylindrical; however, there may be slight deviations from this cylindrical surface at the top and bottom of the cavity from interactions between the rotating fluid and the top 431, 432 and bottom 435, 436 of the cylinder 201, 202. The significant difference between the rotating-liquid piston engine of the present invention and the prior art flat liquid piston engine is the fast circular rotation of the liquid piston around the walls of the cylindrical vessel of the present invention. Rotation is used to stabilize the working surface of the liquid piston. For this rotating-liquid piston, a stability criterions (St) may be determined from the centrifugal acceleration $a_c$ and the radial acceleration $a_r$, as noted later herein.

A brief summary of the operation of the preferred embodiment engine is as follows. For ease of depiction, FIG. 4 shows the inlet 433, 434 and outlet 437, 438 valves of both cylinders 201, 202 open; further, the valves, their actuators, and control means are depicted schematically. As depicted in both FIGS. 2 and 4, the cavity 215 in cylinder 201 may be assumed to contain a full charge of a fuel/air mixture which has been provided to the cavity 215 by an open inlet valve 433 and an appropriate carburetion system (partially shown). Then this inlet valve 433 is closed. The pressure in cylinder 202 is high due to the recent combustion of a fuel/air mixture in its cavity 216. A flow control valve 207 is opened allowing liquid to flow into cylinder 201 performing useful work through a hydromotor 205 and also compressing the gases in cylinder 201. At the moment of maximum compression, a spark plug (not shown) ignites the gases. After combustion of the fuel, the other flow control valve 208 opens and the open flow control valve 207 closes so that liquid may now flow under pressure (because of the combustion in cylinder 201) from cylinder 201 into cylinder 202. At the end of the expansion "stroke" of the cavity 215, the combustion gases exit through the now opened exhaust valve 437. A portion of the exhaust system is also depicted in FIG. 4. The pressure remaining from the combustion process forces most of the combustion gases out of the cavity 215, then the exhaust valve 437 closes. Further expansion of the cavity 215 due to some inertia of the liquid 213 causes a slight rarefaction in the cavity 215 necessary for the suction of the fuel mixture into the cavity when the intake valve 433 is opened (after the exhaust valve 437 is closed). The cycle then repeats itself. In this manner, fluid is transferred back and forth between the two cylinders at some variable frequency, as a result of the pressure from combustion.

The inlet 433, 434 and outlet 437, 438 valves are controlled by an appropriate control means 439, 440, 441, 442. A control means 443 may control the flow control valves and any ignition system, as well as these control means 439, 440, 441, 442. Such a control means 443 may be an appropriately programmed microcomputer or microprocessor. As is clear, this is a two stroke power cycle. In addition, the engine may work in a diesel mode when fuel is injected into the cavity slightly before the moment of maximum compression, i.e., when the temperature is high enough for self-ignition. By controlling the amount of fuel/air supplied to the cavities, the engine may accelerate, decelerate, or be maintained at a constant speed.

Although FIG. 4 depicts the inlet valve 433, 434 at the top and the exhaust valve 437, 438 at the bottom of a cylinder 201, 202, clearly these positions may be interchanged. Further, both the inlet and outlet valves may be at the top or bottom of a cylinder. These valves may be operated by conventional means, such as for example, but not limited to, hydraulic or other type of pressurized fluid, or electromechanically. That is, the valve stem sealingly extends through the appropriate intake or exhaust line and is actuated by a washer-like extension contained in a sealed chamber by fluid pressure (i.e. a hydraulic ram) with the fluid applied by an appropriately controlled valve. FIG. 5 depicts how such a fluid system may be employed to move an inlet and/or outlet valve. Alternatively, as depicted in FIG. 6, an electric solenoid might be used to expel the valve shaft and a spring used to mechanically return the shaft into the solenoid, or two electric solenoids employed (one to open the valve and one to close the valve).

More particularly, FIG. 5 schematically depicts a separate fluid supply system 510 for providing the power to move a piston 512 associated with an inlet and/or outlet valve 514. This fluid is supplied to the piston via a control valve 520. The control valve 520 is in turn controlled by a control means 530. This control means 530 may be a portion of the overall control means 443 described earlier, or may be a separate control means for the inlet and/or outlet valves of one or more cylinders. The separate fluid supply system 510 may employ its own reservoir and fluid pump for engine startup and then switch to and use the pressurized fluid from cylinders.

Similarly, FIG. 6 schematically depicts an electrical way to operate inlet and/or outlet valves. This manner of operating the valves does not require a separate fluid supply system and only requires an electrical power source 600, such as a DC battery (not shown), to energize a solenoid 610. The solenoid 610 is energized by a control means 620 to open the valve 630 and then a mechanical spring 640 may close the valve 630 when the solenoid 610 is de-energized. As noted above, the control means 620 may be a portion of the overall control means 443 or may be an independent control means. Although not depicted, two such solenoids may be employed; one solenoid opens the valve and one solenoid closes the valve. The solenoid that closes the valve would probably have to remain energized when it was desired to have the valve shut.

The essentially closed chamber member needed for the present invention may be fabricated from an upper 431 and lower 435 cover element and a center cylindrical element 444. These elements may include flanges, as depicted in FIG. 4, to allow for easy disassembly and assembly of such a chamber member. Appropriate fasteners (not depicted), such as, but not limited to, threaded bolts or screws with threaded openings in the opposite flange may be employed, or alternatively, the bolts or screws may pass through both of the flanges and employ washers and nuts on the bolts or screws to fasten the two flanges, together. Appropriate pressure retaining seals (not depicted) also may be employed between the two elements to prevent leakage of pressure from the interior of the chamber member.

FIG. 7 depicts generally the various pressures and cavity sizes experienced by the cavity and fluid associated with a rotating-liquid piston of the present invention during an otto cycle. The horizontal axis of FIG. 7 represents the radial distance from the central axis. The vertical axis of FIG. 7 represents pressure, either in the cavity or in the liquid. Curve a of FIG. 7 generally illustrates a pressure curve that results from the maximum compression of an unignited fuel and air mixture; that is, the cavity radius is at its minimum and the cavity wall experiences its maximum non-combustion pressure. The rotational energy of the rotating fluid causes the fluid to be subjected to increasing pressures the further the fluid is from the center of the cylinder. Thus, curve a increases from the wall of the cavity to the wall of the cylinder.

Curve b of FIG. 7 generally illustrates a pressure curve that results after the fuel and air mixture has been combusted. Because of this combustion and its associated expansion process, the pressure inside the cavity increases to some new higher value. The combustion process nearly instantaneously shifts the a curve up to some new cavity pressure resulting in curve b. The pressure change associated with combustion propagates at the speed of sound (approximately 1500 m/sec). The velocity of rotation of the cavity wall (approximately 10–20 m/sec) is two orders of magnitude less than the speed of sound. Accordingly, the rotating liquid undergoes a nearly instantaneous change in pressure after ignition and combustion.

This increased pressure resulting from combustion may then be used to perform useful work. That is, the pressure is used to force fluid out of the cylinder through an outlet conduit and then useful work is extracted via a hydromotor. As the fluid exits the cylinder, the cavity expands and the pressure in the cavity decreases. This continues until some maximum expansion has occurred. Curve c represents this maximum expansion and generally the resulting lowered pressure curve.

At this point, the exhaust valve may be opened to exhaust the combustion products and lower the pressure in the cavity. This results in curve d as the resulting pressure curve. The pressure in the cavity is nearly at atmospheric pressure. The inertia of the fluid causes the cavity to continue its expansion slightly. This slight expansion reduces the cavity pressure below atmospheric pressure and causes an air and fuel mixture to flow into the cavity when the intake valve is opened; however, the fuel also might be injected via a fuel injector.

The depicted quick changes in pressure do not take into account the small but finite amount of time needed for the combustion process to occur. Two different combustion regimes are possible: a) usual combustion, or b) the unusual self-detonation. Self-detonation is considered dangerous in conventional engines. To avoid such detonation, the compression ratio of conventional engines is limited and this decreases the efficiency of the engines. The engine of the present invention allows, in principle, a way to overcome this restriction on compression ratio to avoid some of the problems related to detonation.

In the engines of the present invention, detonation will result in hydroshocks, but their effect is greatly reduced by the "effective" elastic properties of the rotating fluid. A discussion of this elastic damping is provided later herein with a discussion of the results of a mathematical model for the preferred embodiment of the present invention. The rotating liquid in the engine of the present invention simultaneously provides three functions: (a) it creates a stable cavity; (b) it stores rotating kinetic energy (liquid fly-wheel); and (c) it has effective elastic properties for damping detonation.

Figure 8:
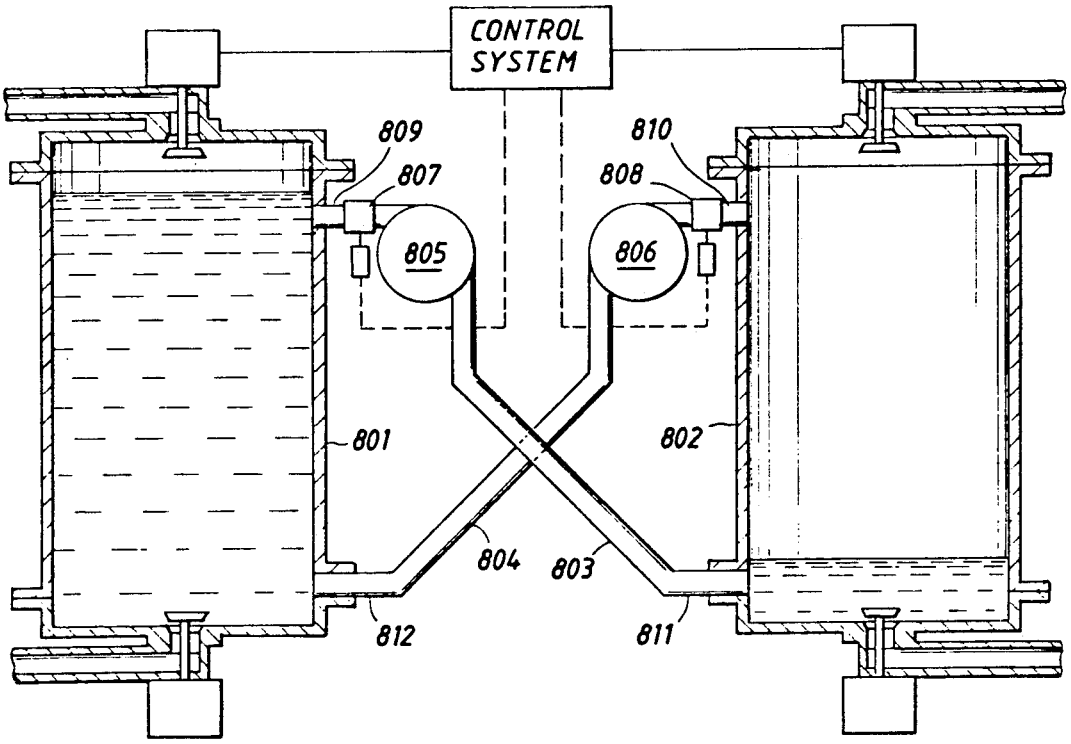
FIG. 8 is a vertical view, partially in cross-section, of an engine similar to FIG. 2 immediately before starting or shortly after stopping the engine.

Referring now to FIG. 8 there may be seen a vertical view, partially in cross-section, of a modified embodiment similar to that depicted in FIGS. 2 and 4 in a non-operating configuration. The engine may be stopped by not providing any fuel/air mixture to the cavities and not opening the flow control valves; after some time the rotating liquid will cease rotating and a residual pressure may occur in one cylinder. In FIG. 8, the outlets 812, 811 are at the bottom of cylinders 801, 802, as presently preferred. The engine may be initially started by using some residual compression from earlier operations. That is, there is some residual compression in the top of cylinder 801 from earlier operations. The appropriate flow control valve 808 is opened, which allows the liquid to move under pressure from cylinder 801 to the tangential inlet 810 of cylinder 802 (through a hydromotor 806) and thereby establish the swirling vortex, with its associated cylindrical cavity, in cylinder 802. Then, a fuel charge may be injected into the cavity, after which ignition may occur and the engine will begin working in its normal cyclical mode.

Alternatively, the engine may be started by a motor (not shown). A motor (or motors) may be used to drive one (or both) of the hydromotors 805, 806 to transfer fluid from one cylinder to the other to establish the swirling liquid piston flow via their tangential inlets 809, 810. Fuel flow is appropriately initiated, followed by combustion and then the working cyclic mode begins. (Note that the direction of fluid flow in the flow tubing 804, 803 is reversed between FIG. 8 and FIGS. 2 and 4 because of the outlets 812, 811 being at the bottom of the cylinder, as preferred.)

Although the foregoing description has mostly been for a two stroke power cycle with two cylinders, clearly any number of rotating-liquid piston cylinders may be so employed. Also, clearly a four stroke cycle may be used, after the control means controlling the flow control valves, inlet and outlet valves and the ignition system is appropriately adjusted. It is also possible to have one or more pressure receivers that act as a pressure accumulator for all the cylinders. The engine piston(s) (cylinder(s)) supplies pressurized liquid to the pressure receiver from which the liquid is independently fed to one or more appropriately sized hydromotors. For such a receiver embodiment with one receiver, one arrangement is for all the tangential outlets from the cylinders to be combined into a single inlet header into the receiver (each outlet having its own fast-acting isolation valve) and an outlet header from the receiver with lines to the tangential inlet of each cylinder (with each line having its own fact-acting isolation valve).

For a four stroke power cycle, the increased rotational energy of the cylinder containing the smallest cavity is used in off-power "strokes" (expansion of a cavity) to provide the energy to move fluid from one cylinder (with a small cavity) to the other cylinder (with a large cavity). In addition, once the fluid motion has begun, it acquires its own "inertia" that tends to continue the fluid flow, even when the rotational energy of the fluids in the two cylinders is balanced or nearly balanced. That is, the rotating liquid layer has a considerable amount of rotational kinetic energy that may be transformed into pressure during the operational cycle of the engine. Because the frictional forces in the rotating-liquid piston engine of the present invention are considerably less than for a conventional piston engine, much less kinetic energy needs to be stored in a flywheel, allowing for a much smaller flywheel. The rotating liquid layer replaces the flywheel of a conventional engine. This "liquid" flywheel allows the engines of the present invention to operate in either a two-stroke or four-stroke cycle.

Figure 9:
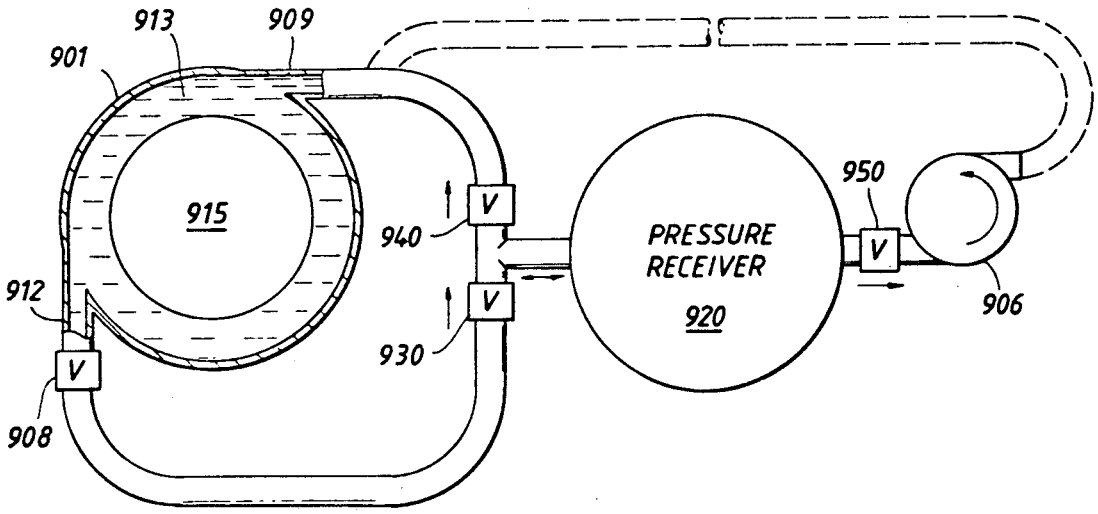
FIG. 9 is a simplified functional diagram of a single cylinder embodiment of a rotating-liquid piston internal combustion engine of the present invention.

Although the previous description herein has been in terms of two cylinders interconnected by appropriate piping, the internal combustion rotating-liquid piston engine of the present invention may also employ a single rotating-liquid piston. Such a single piston engine is depicted in FIG. 9. Alternatively, the embodiment of FIGS. 2 and 4 may be employed as a single piston engine when one cylinder has no ignition, intake, or exhaust system and merely serves as a pressure accumulator. More particularly, for a single cylinder rotating-liquid piston engine, a reservoir or pressure accumulator is necessary to act as a pressure source to ensure satisfactory operation of the engine. Such a single cylinder engine may be used as a pump to pump the fluid used to make the rotating-liquid piston.

More particularly, FIG. 9 depicts a single cylinder embodiment of the present invention. It has a single cylinder 901 with a rotating-liquid piston and a tangential inlet 909 and outlet 912 as described herein before and would operate as described herein before. In this embodiment a pressure receiver 920 is used to accumulate the fluid and pressure from the combustion of fuel in the cavity. This fluid may then be provided to a hydromotor 906 and then back to the cylinder 901 or provided directly to the cylinder 901. Appropriate valves control fluid flow into the receiver 920 (valves 908, 930 open and valve 940 closed) into the hydromotor 906 (valve 950 open), or back to the cylinder 901 from the receiver 920 (valve 940 open and valve 930 closed). Although FIG. 9 employs two flow control valves 908 and 930 in the outlet tube, only one is required and may be 930 by itself.

Although not depicted the outlet from the hydromotor could be the supply for a system requiring a fluid supply and the inlet to the cylinder is a suction for that system. In this manner, the single cylinder embodiment may pump the fluid that serves to establish its rotating-liquid piston.

Based on the foregoing description and principle of operation of the present rotating-liquid piston engine, it is believed that it is possible to construct and design engines employing different thermodynamic cycles. For example, otto, diesel, or stirling cycles may be constructed according to these teachings.

As noted hereinbefore, several different liquids may be employed as the liquid to form the rotating-liquid piston of the engines of the present invention. Water is presently preferred for automobile applications because the presence of water during the combustion of hydrocarbons will ensure that the combustion is more complete and will lower the amount of nitrous oxides emitted in the exhaust gases from the engine of the present invention. In addition, the evaporation of some of the water into the cavity of the piston will also cool the system.

In addition, if a receiver is available it then leads to a new type of hydrodynamic braking, when at least, a part of the kinetic energy is transferred not into heat but into pressure energy in the receiver. That is, the hydromotor may be used as a hydropump to provide additional energy in the receiver.

Prior experiments (by the inventor) have demonstrated that a stable interior cavity and cavity surface may be created in a rotating body of liquid in a cylindrical device. This device employed tangential inlets for a liquid to establish a rotating body of liquid. The cavity in the liquid was not subjected to any pressure, other than normal atmospheric pressure (to which it was openly exposed).

In general, based upon such prior experiments, it is known that the centrifugal forces of the rotating liquid are much greater than any forces associated with the viscosity of the liquid. Accordingly, the influence of viscosity is very small and for most (if not all) considerations, may be safely neglected. However, there is a thin boundary layer between the surfaces of the cylinder and the rotating liquid. Other than this boundary layer, the liquid behaves as an "ideal" liquid and may be so treated. There may also be a small interaction between the rotating liquid at the top and bottom of a cylinder and the top and bottom of the cylinder.

A mathematical model describing the behavior of the preferred two cylinder embodiment of the engine of the present invention has been developed and demonstrates the operation of the present invention. This model takes into account the main hydrodynamic and thermodynamic processes associated with this engine. The model permits the calculation of the main engine characteristics (power, compression ratio, efficiency, stability criterion) for a given design and selected operating parameters.

The model assumes an unsteady flow of essentially incompressible liquid in two identical interconnected ring domains, i.e., the rotating vortex of liquid in two cylinders with a central cavity in each, as depicted in FIGS. 2 and 4. Near-center cavities in the rings are filled by an ideal gas (one that obeys the ideal gas law) and have time-dependent radii measured from the center axis, $b_1(t)$ and $b_2(t)$, respectively. Flow between and thermal expansion and contraction processes in the cavities of the rings run in opposite phases and a self-oscillating process occurs. The connections between the rings contain hydraulic loads (hydromotors) to provide useful work. The following equations are derived in a polar coordinate system (centered in and at the bottom of a ring), and each "ring" is assumed to be axially symmetric, which removes any polar angle dependencies.

The velocity field in each ring is given by $$V_r = Q/r, \text{ and} \tag{1a}$$

$$V_\phi = \Gamma/r \tag{1b}$$

where $V_r$ is the radial velocity (expansion/contraction), $V_\phi$ is the tangential velocity, and r is the distance from the ring center, and the quantities $Q=Q(t)$ and $\Gamma=$const. are related to the physical flow rate $Q_p$ and physical circulation $\Gamma_p$ by, $$Q_p = 2\pi h\, Q, \text{ and} \tag{1c}$$

$$\Gamma_p = 2\pi\Gamma \tag{1d}$$

where h is the height of the chamber.

The conservation of the fluid volume gives the relation $$b_1^2 + b_2^2 = 2\sigma R^2 \tag{2}$$

where R is the ring radius and $2\sigma$ is a relative gas to total ring volume ratio.

The normalized flow rate Q(t) is related to the radius b(t) by the equation (from equation 1a, where $V_r$ is b and r is b)

$$Q = b\,\dot{b} \tag{3}$$

where the dot means differentiation with respect to time.

From the standard Euler hydrodynamic equations and assuming axial symmetry, the following dimensionless differential equation may be derived:

$$\ddot{Z}_1 \ln \frac{1}{Z_1 Z_2} - \frac{\dot{Z}_1 + \gamma^2}{2}\left(\frac{1}{Z_1} - \frac{1}{Z_2}\right) + \frac{\xi}{2}\,|\dot{Z}_1|\dot{Z}_1 = 4(f_1 - f_2) \tag{4}$$

where $Z=b^2|R^2$, $\gamma=2\Gamma|(CR)$, $C^2=p_o|\rho$, $$\tau = \frac{C}{R}\, t_{po}$$

is atmospheric pressure, $f=p|p_o$, $y=Z-\sigma$, p is the pressure in a cavity, $\rho$ is the fluid density, and $\xi$ is a coefficient of the hydraulic load related to a pressure drop, $\Delta p$, across a hydromotor, given by, $$|\Delta p| = \frac{1}{2}\,\xi\,\frac{\rho}{R^2}\,Q^2. \tag{5}$$

$Z_1$ and $Z_2$ are related by, $$Z_1 + Z_2 = 2\sigma. \tag{6}$$

Functions $f_1$ and $f_2$ are determined by thermodynamic equations and the choice an appropriate a working cycle (such as otto or diesel).

For the general case $$f_1 - f_2 = \left[\frac{\sigma + y_o}{\sigma + y}\right]^k e^{\delta} - \left[\frac{\sigma + y_o}{\sigma - y}\right]^k e^{-\delta} \tag{7}$$

where $$y = Z - \sigma,\ \delta = \frac{k-1}{R_g}\,S$$

and where k is the adiabatic exponent, S is entropy, and $R_g$ is the gas constant. For an otto cycle consisting of two adiabatic and two isobaric expansions, the result is, $$\delta = \pm\beta \text{(with the sign coinciding with the sign of } \dot{y}) \tag{8}$$

where $\beta$ is the entropy drop in the cycle and $\beta$ is proportional to the flow rate of fuel.

The equations (2)–(8) together with the following initial conditions, $$y(0) = y_0 \text{ and } \dot{y}(0) = 0 \tag{9}$$

constitute a closed problem which may be solved numerically. The value of $y_0$ has to be chosen to provide a periodic process or oscillatory operation. The solution of the problem gives all the dynamical characteristics of the engine as follows:

1) power (N)

$$N = \frac{\pi R h}{8\tau_c} p_o C \xi \int_o^{\tau_c} |\dot{y}|^3 d\tau \quad (10)$$

where $\tau_c$ is a dimensionless period (i.e., the period of one cycle);

2) efficiency $\eta$ $$\eta = 1 - \epsilon^{1-k} \quad (11)$$

(see *Thermodynamics*, by V. M. Faires, 1970, p. 368), $$\text{where } \epsilon = \frac{Z_o}{Z_{min}} = \frac{\sigma + y_o}{\sigma - y_o} \quad (12)$$

and $\epsilon$ is the compression ratio;

3) stability criterion (St)

$$St = a_c/a_r = \frac{\gamma^2}{2(\sigma - y_o)y} \quad (13)$$

where $a_c$ is a centrifugal acceleration, $a_r$ is the radial acceleration of the fluid at a time of the maximum compression; and 4) eigenfrequency of small oscillations of the system, $$\omega_o = \sqrt{(\gamma^2 + 8k\sigma)/[\sigma^2 \ln(1/\sigma^2)]} \quad (14)$$

This eigenfrequency expression illustrates that the rotational intensity $\gamma$ acts or behaves as an elastic constant (by analogy to a conventional damped spring oscillator) and thus the rotating fluid has elastic properties that may be used to damp out detonations that would be harmful to a conventional piston engine. In the engines of the present invention, detonation will result in hydroshocks, but their effect is greatly reduced by the "effective" elastic properties of the rotating fluid. Thus, the rotating liquid in the engine of the present invention simultaneously provides three functions: (a) it creates a stable cavity; (b) it stores rotating kinetic energy (liquid fly-wheel); and (c) it has effective elastic properties for damping detonation.

Selected data from these calculations are shown in the Table A below. Power N (Kwt) and pressure drop $\Delta p$ (atm) are obtained for the two cylinders with R=h=0.1 meter. Other quantities are dimensionless. In these calculations the following parameters have been fixed:

TABLE A

| N | $\beta$ | St | $a_c/g$ | $\Delta p$ | $\epsilon$ | $\eta$ |
|---|---|---|---|---|---|---|
| 20 | 1.189 | 113 | 468 | 3 | 4.64 | 0.459 |
| 45 | 1.476 | 92.3 | 763 | 8.5 | 6.83 | 0.536 |
| 101 | 1.784 | 72.7 | 1335 | 14 | 10.3 | 0.607 |
| 1153 | 2.8 | 31.1 | 9480 | 58 | 40.9 | 0.773 |

$p = 1000\ Kg\ m^{-3}$
$k = 1.4$
$\xi = 5000$
$\gamma = 1$
$\sigma = 0.4$

The last line in the table is data characteristic of a diesel engine rather than an otto engine.

As an example of the amount of power (101 Kw) that may be obtained from a preferred two cylinder engine constructed in accordance with the teachings of the present invention, the following numerical example is offered. The radius of both cylinders is 0.1 meters, the height of both cylinders is 0.1 meters, and the radius of the interior cavity is 0.05 meters at the moment when the cavities in both cylinders are of the same size. The sectional area, A, of the tangential inlets and outlets is 20 $cm^2$ and if the velocity, V, of the input liquid is 10 meters per second then the average liquid consumption $\bar{Q}$ will be $$\bar{Q} = A \cdot V,$$

which is equal to 0.02$m^3$ per second. The corresponding pressure drop across a hydromotor is 14 atmospheres.

If the dimensions of the hydromotor or hydroturbine are the same as those of the engine, i.e., the radius and the height being equal to 0.1 meters and the inlet velocity being 20 meters per second, then the area of the inlet port should be about 10 $cm^2$. It is known from turbine theory that at this fluid velocity, the optimal tip velocity of the blades is about 10 meters per second. As an example, if this turbine is then directly driving a wheel of an automobile having a radius of 0.3 meters, the speed of the car would be approximately 67½ miles per hour. These calculations indicate that at least for an automobile application a transmission and reduction gear may not be needed.

A distinctive feature of the rotating-liquid piston internal combustion engine of the present invention is that its efficiency will increase with an increase of power. This can be explained by the increase in the amplitude of oscillation of the cavity radius and therefore of the compression ratio ($\epsilon$). The rotating-liquid piston internal combustion engine of the present invention differs significantly from a conventional internal combustion engine for which the compression ratio is fixed and/or for which the efficiency decreases with an increase in power.

For the values of the above noted parameters when the power is about 100 kW (which is equal to about 136 horsepower), the thermal efficiency is a rather high 0.6 and the compression ratio is about 10 which is nearly a typical compression ratio (9.7) for modern internal combustion engines operating in a conventional otto cycle. When running in a diesel mode, because of the increased compression ratio, the power and efficiency of the engine of the present invention of the same size will increase significantly. The present invention thus provides a very small sized and powerful diesel engine for various uses.

The design of the rotating-liquid piston internal combustion engine of the present invention allows for the use of either a combustible hydrocarbon gas or liquid as a fuel, including low grade fuels. This is because the rotating-liquid piston is insensitive to detonation. The stability criteria (St) for the numerical example considered previously is 72, which ensures a large margin of stability. The value of the acceleration in the maximum compression stage becomes very large and is approximately 1,300 g. This also indicates a highly stable surface for the rotating-liquid piston.

Besides the large margin of stability and the high compression ratio, there is an additional stabilizing factor of the strong dependence of centrifugal acceleration on radius (i.e., the centrifugal acceleration is inversely proportional to the cube of the radius); this creates a gradient in the centrifugal acceleration. If during the most dangerous moment of maximum compression and ignition a drop somehow separates from the surface of the rotating liquid, the gradient of the centrifugal acceleration will cause the drop to immediately return to the surface. At the same time, however, when gas penetrates the rotating liquid surface, a powerful rotating buoyancy force makes such gas penetration nearly impossible.

Thus, it may be seen that the engines of the present invention provide a small, simple, thermally efficient, and light engine capable of generating large amounts of power from any kind of combustible hydrocarbon gas or liquid fuel. Further, the present invention provides methods for converting energy (from combustion, heat, or other sources) into useful work. Such methods employ a liquid vortex having therein a cavity (or expansion zone) capable of expansion and contraction. This cavity has an energy containing medium capable of producing pressure passed into the cavity that causes the cavity to expand. Liquid is recovered from the vortex as a result of this expansion and is used to provide useful work. The cavity pressure may then be exhausted and the cavity contracted by the tangential addition of fluid to the liquid vortex. The process may then start over.

Many other variations and modifications may be made in the apparatus and techniques hereinbefore described, by those having experience in this technology, without departing from the concepts of the present invention. Accordingly, it should be clearly understood that the apparatus and methods depicted in the accompanying drawings and referred to in the foregoing description are illustrative only and are not intended as limitations on the scope of the present invention.

What is claimed is:

1. A rotating-liquid piston engine, comprising:
a liquid vortex having therein a cavity capable of expansion,
a selectively operable opening into said cavity for allowing an energy containing medium capable of producing pressure into or out of said cavity,
a selectively operable tangential opening for said vortex to allow liquid to exit said vortex responsive to pressures in said cavity, and
means for converting energy in said liquid vortex into some other form of useful work.

2. The engine of claim 1, wherein said means for converting comprises a means for converting energy in liquid exiting said vortex into some other form of useful work.

3. The engine of claim 1, further comprising:
a selectively operable tangential opening for introducing liquid into said vortex.

4. The engine of claim 1 and further comprising:
a pressure receiver operatively interconnected with said tangential opening to allow liquid to exit.

5. A method for converting energy into useful work, comprising:
providing a liquid vortex having therein an expansion zone capable of expansion,
passing an energy containing medium into said expansion zone,
expanding said expansion zone responsive to said medium,
recovering liquid from said vortex as a result of said expanding step, and
providing useful work with said recovered liquid.

6. The method of claim 5, further comprising:
contracting said cavity by tangentially adding liquid to said vortex.

7. A rotating-liquid piston internal combustion engine, comprising:
a liquid vortex having a substantially cylindrical cavity for a combustion chamber,
means for selectively introducing a combustible fuel and air into said combustion chamber,
means for selectively exhausting combusted fuel and air from said combustion chamber,
means for tangentially introducing liquid into said vortex,
means for tangentially recovering liquid from said vortex, and
means for converting liquid energy into some rotational or pressure energy coupled to said means for recovering liquid.

8. The engine of claim 7, further comprising:
at least two cylinders having upper and lower covers, each for containing a liquid vortex, and
wherein said means for selectively introducing and selectively exhausting comprise intake and exhaust valves associated with the upper and lower covers, respectively, and wherein said means for tangentially introducing and tangentially recovering comprise a system of inlet and outlet tubes tangentially leading into said cylinders with inlet and outlet openings, and wherein said means for converting, comprises one or more hydromotors interconnected between the cylinders by means of said tubes.

9. The engine of claim 8, further comprising:
a liquid which partially fills up these cylinders and rotates in a vortex in the cylinders when said engine is running and provides said cavity therein which serves as the combustion chamber.

10. The engine of claim 9, further comprising:
at least one flow control valve in each tube.

11. The engine of claim 9, wherein said liquid is selected from the group comprising, a combustible liquid hydrocarbon, water, antifreeze, or mixtures thereof.

12. A method for converting energy from combustion into useful work, comprising:
providing a liquid vortex having therein an expansion zone capable of expansion,
passing a combustible fuel and air into said expansion zone,
compressing said fuel and air in said expansion zone,
combusting said fuel and air in said expansion zone,
expanding said expansion zone responsive to said combustion,
recovering liquid from said vortex as a result of said expanding step, and
providing useful work with said recovered liquid.

13. The method of claim 12, further comprising:
contracting said cavity by tangentially adding liquid to said vortex.

* * * * *